US005606926A

United States Patent [19]

Schroeder, Jr. et al.

[11] Patent Number: 5,606,926

[45] Date of Patent: Mar. 4, 1997

[54] METHOD AND APPARATUS FOR DETECTING AN ABERRATIONAL STITCH IN REAL TIME

[75] Inventors: Roy E. Schroeder, Jr., Elmhurst, Ill.; Robert T. McGuire, Hobart, Ind.

[73] Assignee: Quick Technologies, Inc., Elmhurst, Ill.

[21] Appl. No.: 532,238

[22] Filed: Sep. 22, 1995

[51] Int. Cl.[6] ..... D05B 69/36

[52] U.S. Cl. ..... 112/273; 112/475.01

[58] Field of Search ..... 112/273, 278, 112/302, 275, 277, 470.01, 470.02, 475.01

[56] References Cited

U.S. PATENT DOCUMENTS 3,843,883 10/1974 DeVita et al. ..... 112/273 X
4,426,948 1/1984 Olasz et al. ..... 112/273
4,691,648 9/1987 Hirose ..... 112/273 X
4,993,337 2/1991 Matsubara ..... 112/273
5,018,465 5/1991 Hager et al. ..... 112/273

*Primary Examiner*—Peter Nerbun
*Attorney, Agent, or Firm*—Lee, Mann, Smith, McWilliams, Sweeney, & Ohslon

[57] ABSTRACT

A method and apparatus for detecting an aberrational stitch, normally a skipped stitch, in real time in a sewing apparatus. Movement of thread is detected, and a signal is generated if the thread is moving. At the same time, revolution of the handwheel of the sewing machine is detected, and pulses representative of the revolution are generated. The pulses are accumulated so long as the thread is moving, and the accumulated pulses are compared with a minimum number of pulses for a period of time. After one revolution of the sewing machine handwheel, representative of one stitch, the results of the comparisons are used to determine an aberrational stitch, and if a malformed stitch is detected., the sewing apparatus is stopped.

10 Claims, 3 Drawing Sheets

METHOD AND APPARATUS FOR DETECTING AN ABERRATIONAL STITCH IN REAL TIME

BACKGROUND OF THE INVENTION

This invention relates to sewing apparatus, and in particular to a method and apparatus for detecting an aberrational stitch in real time.

A stitch is formed on a chain stitch sewing machine from two threads, a needle thread and a looper thread. As is well known, for and given type of machine, the threads stop and start in repeatable patterns during the generation of each stitch. These patterns are, essentially, independent of the speed of the sewing machine.

When a stitch is malformed, it is important to learn of that malformation and, in most instances, stop the sewing apparatus to correct for the malformed stitch. Generally, a malformed stitch is a skipped stitch, although other problems, such as a stitch that is too tight or broken thread must also be immediately detectable and the apparatus stopped as quickly as possible.

Various devices have been developed to detect aberrational stitches. For example, U.S. Pat. No. 5,383,417 monitors the stitching process to detect a skipped stitch. In one version of the apparatus, an optical detector is used to sense thread movement and break the beam of the optical sensor at the same point in time in each acceptable stitch. When a skipped stitch occurs, however, the beam is not broken, or is broken at a different time, and that data is used to stop the sewing machine. However, given the nature of the machine, detection is not in real time, and stopping occurs only after a lag.

Various apparatus has been developed to monitor breaks in the sewing machine thread. U.S. Pat. Nos. 4,841,890; 5,199,365 and 5,359,949 are examples of thread break monitors. Similarly, U.S. Pat. No. 4,805,544 uses an optical detector to determine when a bobbin has run out of thread.

U.S. Pat. No. 4,192,243 discloses a system to determine whether the stitching is too loose or too tight. It compares the number of stitches to the consumption of thread by the sewing machine. If the stitch count to thread usage is low, the stitches are considered to be too loose and an alarm is generated. If the stitch count to thread use is high, the stitches are considered to be too tight and an alarm is also generated. Similarly, broken thread is also detected.

SUMMARY OF THE INVENTION

The invention is directed to a method and apparatus for detecting an aberrational stitch in real time. In accordance with the method, the movement of thread in the sewing apparatus is sensed. A first signal is generated indicative of movement of the thread and a second signal is generated indicative of lack of movement of the thread. The sewing apparatus has a handwheel and its revolution is represented by generating a predetermined number of electrical pulses per revolution. Selected ones of the electrical pulses are accumulated as the first signal indicative of movement of thread is generated. The accumulated selected electrical pulses are compared with a predetermined minimum number of those pulses, and a stopping signal is generated responsive to a particular result of the pulse comparison.

In accordance with the preferred form of the invention, each revolution of the sewing apparatus handwheel represents one stitch, and it is preferred that each revolution of the handwheel is divided into a series of equal segments. For each segment, selected electrical pulses are accumulated and compared with a predetermined minimum number of pulses required, and if the number of selected pulses exceeds the minimum number, that fact is counted. After one revolution of the handwheel, representing a single stitch, the number of counted comparisons is compared with a predetermined threshold number of comparisons for one revolution of the handwheel, and if the counted number exceeds the threshold number, the stitch is considered to be correct. However, if the counted number does not exceed the threshold number, or if the counted number exceeds a predetermined maximum number, the stitch is considered to be aberrational, and the stopping signal is generated.

The system according to the invention comprises detecting means for sensing thread movement. Signal means is provided responsive to the detecting means for generating a first signal indicative of movement of the thread and a second signal indicative of lack of movement of the thread. Encoder means is provided for creating a representation of revolution of the handwheel of the sewing apparatus, the encoder means including pulse means for generating a predetermined number of electrical pulses per revolution of the handwheel. Accumulator means, connected to the signal means and responsive to the encoder means, is provided to accumulate selected ones of the electrical pulses. Processor means connected to the accumulator means is provided for comparing the selected electrical pulses with a predetermined number of electrical pulses, and means is provided to generate a stop signal for the sewing apparatus responsive to the comparison in the processor means.

In accordance with the preferred form of the invention, there are a plurality of the detecting means. For each detecting means, a signal means and an encoder means is provided.

The accumulator means comprises a counter. The counter is connected for receiving the first signal for enablement and the electrical pulses for counting. The detecting means comprises a rotary encoder which generates the electrical pulses.

In accordance with the preferred form of the invention, means is provided for generating an audible alarm responsive to the detection of an aberrational stitch. Means is also provided for stopping the sewing apparatus upon stitch detection.

BRIEF DESCRIPTION OF THE DRAWINGS

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 1:
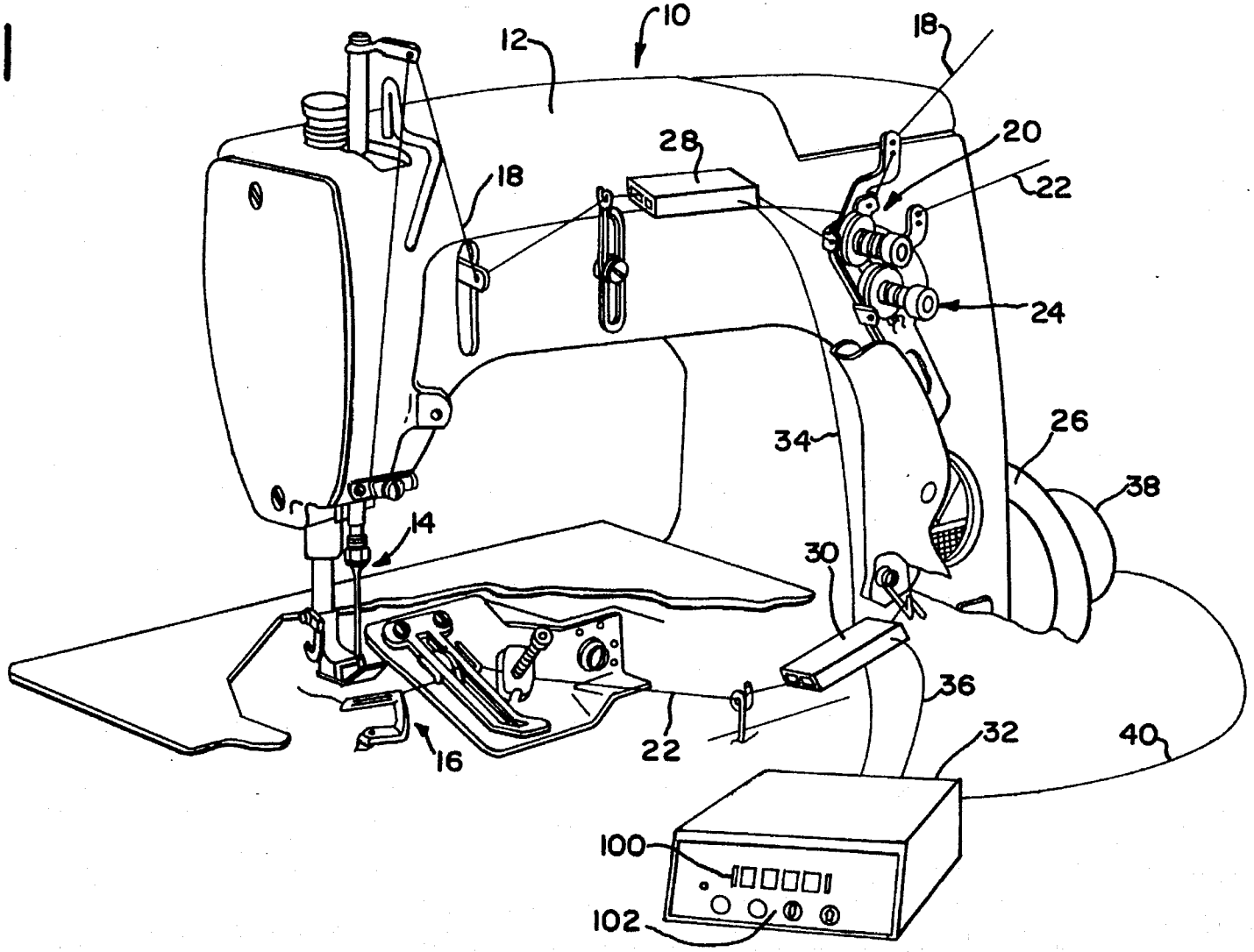
FIG. 1 is a schematic elevational illustration of a sewing apparatus employing the system for monitoring and detecting an aberrational stitch according to the invention, with portions broken away to illustrate detail.

A typical sewing apparatus which can utilize the detecting method according to the invention is shown generally at 10 in FIG. 1. The sewing apparatus 10 includes a machine frame 12 appropriately mounted on a table or other structure for ease of utilization by the machine operator. The apparatus 10 includes a needle assembly 14 and a looper assembly 16. The needle assembly 14 receives needle thread 18 from a source (not illustrated), with the thread 18 being fed through a needle thread tension assembly 20 and then through various eyelets and guides to the needle assembly 16. Those elements depicted in FIG. 1 may be conventional, and therefore are not described in greater detail.

The thread 22 is also fed to the looper assembly 16 from a source (not illustrated) through a looper thread tension assembly 24. Similar to the needle thread 18, the looper thread 22, after leaving the looper thread tension assembly 24, passes through various eyelets and guides on its way to the looper assembly 16. Again, these elements of the invention may be conventional, and therefore are not described in greater detail.

The sewing apparatus 10 also includes a handwheel 26 which rotates as the sewing apparatus 10 is operated. As is typical, the handwheel 26 turns one revolution for each stitch sewn by the sewing apparatus 10. Although this relationship is typical, obviously the sewing apparatus 10 can be geared otherwise so that several stitches can occur in one revolution of the handwheel, or only a portion of a stitch can occur in one revolution, as needs might dictate.

The system for monitoring the sewing apparatus 10 and detecting an aberrational stitch in real time includes sensors 28 and 30 for detecting passage of the respective threads 18 and 22. The thread sensors 28 and 30 each include a phototransistor and a light emitting diode (not illustrated). The thread 18 or 22 passing between the phototransistor and the light emitting diode changes the amount of light received by the phototransistor. When the thread is moving, in the preferred form of the invention each of the sensors 28 and 30 will produce an output of essentially electrical noise of about 0.4 volts. When the thread is not moving, however, the outputs of the sensors 28 and 30 are constant, and in the this version of the invention, stable at 2.5 volts.

The respective sensors 28 and 30 communicate with a microprocessor 32 via wires 34 and 36. The nature of, and functions of, the microprocessor 32 will become apparent below.

A rotary encoder 38 is secured to the handwheel 26. As is typical with rotary encoders, the rotary encoder 38 generates a series of electrical pulses as the handwheel 26 rotates. In the preferred form of the invention, the encoder 38 generates 480 pulses per revolution of the handwheel 26. The electrical pulses generated by the rotary encoder 38 are directed to the stitch monitor or main control unit 32 via a cable 40.

Figure 2:
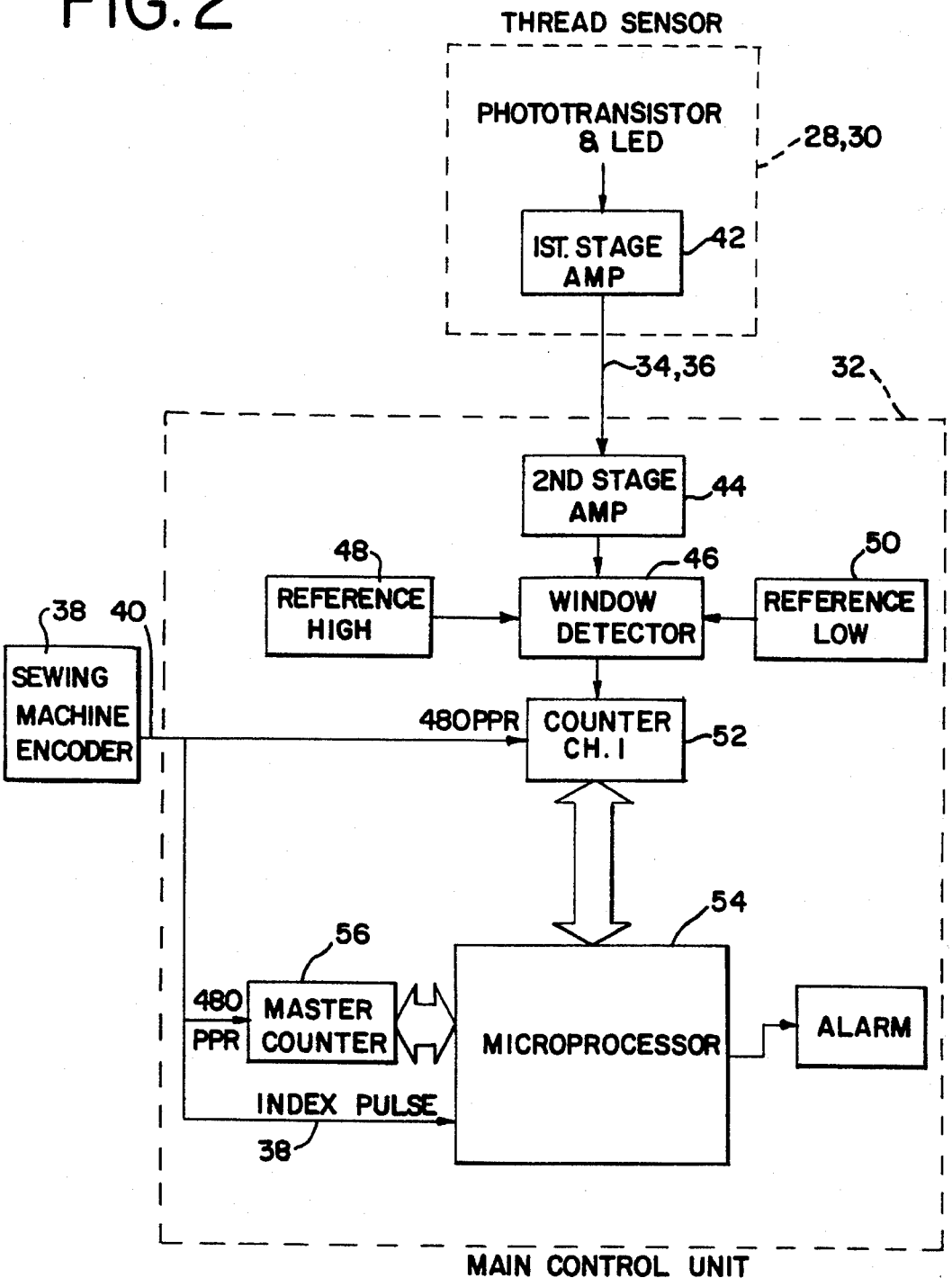
FIG. 2 is a block diagram of the primary elements of the invention essentially showing a single thread sensor.

Turning now to FIG. 2, the components of the system according to the invention are shown in block form, and where those components find correspondence to what is illustrated in FIG. 1, the same reference numerals have been used. As explained above, the thread sensors 28 and 30, which are identical, employ the combination of a light emitting diode (LED) and a phototransistor. The output from that combination is directed to an amplifier 42 producing the output discussed above, where active passage of the thread 18 or 22 produces an output of about 0.4 volts, while when the thread is not moving, the output is stable at about 2.5 volts. In the stitch monitor 32, the output from the thread sensor 28 or 30 is amplified by a second amplifier 44. Given its input, the output from the second amplifier 44 is anywhere between 0 and 5 volts when the thread is moving, and a constant 2.5 volts when the thread is still. The amplifier 44 leads to a window detector 46. The detector 46 has two additional inputs, a high reference input 48 and a low reference input 50. Preferably, the reference level of the high reference input 48 is 2.55 volts while the reference input of the low reference input 50 is 2.45 volts. The detector 46 is formed to produce a digital output, with a digital low being generated whenever the input from the amplifier 44 is above 2.55 volts or below 2.45 volts. When the output from the amplifier 44 is between 2.55 and 2.45 volts, the output from the window detector 46 is a digital high signal. Therefore, whenever the thread is moving through one of the sensors 28 or 30, the output from the window detector 46 is a digital low, while when the thread stops, the output is a digital high.

A counter 52 receives the output from the window detector 46. The counter 52 also has, as an input, the output from the rotary encoder 38. The counter 52 may be conventional, and is enabled upon a digital low from the window detector 46. The counter therefore advances with each of the pulses received from the encoder 38 so long as the output of the detector 46 is low. When the output from the detector 46 is high, however, the counter 52 is not enabled, and the pulses from the encoder 38 do not advance the counter.

The counter 52 is connected to a microprocessor 54. The microprocessor 54 is also connected to a master counter 56 which is fed by the output of the encoder 38. The processor 54 also has as an input an index pulse from the encoder 38 on a line 58. The index pulse on the line 58 is generated once for each revolution of the handwheel 26.

Figure 3:
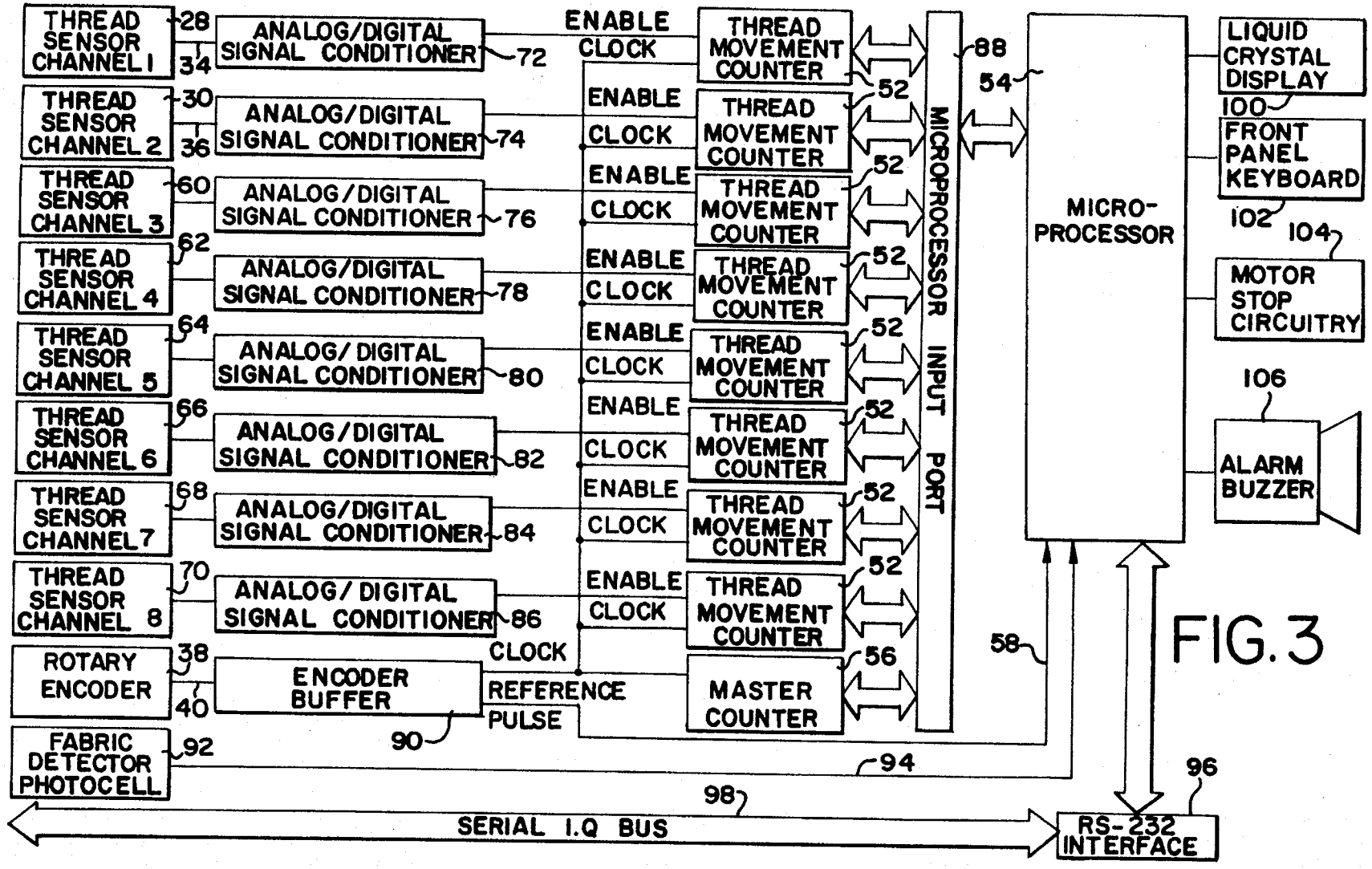
FIG. 3 is a block diagram similar to FIG. 2, but illustrating a multi-channel system in additional detail for sensing up to eight different threads.

Turning to FIG. 3, a somewhat more detailed block diagram is illustrated, but having eight sensors as input, with the sensors 28 and 30 being shown in FIG. 1, as well, and with additional sensors 60 through 70 being depicted. Each of the sensors 28, 30 and 60 through 70 is connected to a respective signal conditioner 72 through 86 each of which is simply a combination of the amplifier 44, window detector 46, high reference input 48 and low reference input 50. The outputs of the respective signal conditioners 72 through 86 then feed eight separate thread counters, each corresponding to the counter 52. The counters 52 are connected to the microprocessor 54 by means of a conventional input port 88.

Output from the rotary encoder 38 passes through a conventional encoder buffer 90 to the master counter 56, with the reference pulse on the line 58 being directed directly to the microprocessor 54. Also, if desired, a fabric detector 92 can be employed in proximity to the sewing apparatus 10 to detect the presence or absence of fabric in the sewing apparatus 10. That signal is passed to the microprocessor 54 via a line 94.

The microprocessor 54 preferably is programmable in a conventional fashion. For that purpose, an RS-232 interface 96 to the microprocessor 54 is provided, the interface 96 being connectable to a bus 98 in communication with a computer (not illustrated) or other input device.

A display 100 is connected to the microprocessor 54 to display information, as appropriate. An input panel 102 is also connected to the microprocessor 54, as is an appropriate circuit 104 to stop the motor (not illustrated) of the sewing 10. Also provided is an audible alarm 106.

In operation, as the handwheel 26 rotates, the rotary encoder 38 generates electrical pulses, which are passed through the encoder 90 to the master counter 56, and to each of the thread counters 52. A reference pulse, once each revolution, is passed directly to the microprocessor 54 on the line 94. The reference pulse is used by the microprocessor 54 to maintain synchronization with the sewing apparatus 10.

Signals from the thread sensors (28, 30 and 60 through 70) are directed to their respective signal conditioners 72 through 86. A digital low is an enable signal, indicating the movement of thread, and an enabling the thread counters 52 to accept pulses from the rotary encoder 58.

The microprocessor 54 receives the pulses from the master counter 56. Preferably, the microprocessor 54 divides the pulses into segments. The rotary encoder 38 preferably produces 480 pulses per revolution, and it is preferred that the 480 pulses be divided into 44 segments of 10 pulses each. That leaves the last 40 pulses of each revolution of the encoder 38 (and therefore each stitch) which can be ignored.

The microprocessor 54 reads the output of each of the counters 52 for each of the 44 segments. The count in each of the counters 52 is compared to a predetermined minimum, or threshold, count stored in the microprocessor 54. If the count in the particular counter 52 exceeds the minimum threshold, the microprocessor 54 records that fact and deems the segment to be active.

After a full revolution of the handwheel 26 (and therefore after what is intended to be a complete stitch), the microprocessor 54 determines the number of active segments. A minimum number of active segments is programmed in the microprocessor 54, as well as a predetermined maximum number of active segments. If the number of active segments falls in a window between the minimum and maximum, the stitch is deemed to have been accurately formed, and no further action is taken. If, on the other hand, the number of active segments falls below the minimum or threshold, that is indicative of a skipped stitch. When a skipped stitch occurs, the display 100 displays that fact. In addition, the audible alarm 106 is activated. If the motor stop circuit 104 is enabled, the motor (not illustrated) of the sewing apparatus 10 is automatically disabled, and the sewing operation is immediately halted.

Therefore, the apparatus according to the invention, and the process employed, detects skipped stitches in real time. That is, precisely at the conclusion of a stitch, if the stitch is determined to be malformed, that fact is immediately known, and the sewing apparatus 10 can be halted either manually in response to an audible alarm, or automatically by disabling the motor for the sewing apparatus. Various changes can be made to the invention without departing from the spirit thereof or scope of the following claims.

What is claimed is:

1. In a sewing apparatus, a method of detecting an aberrational stitch in real time, comprising the steps of a. sensing movement of thread in the sewing apparatus, b. generating a first signal indicative of movement of thread and a second signal indicative of lack of movement of thread, c. creating a representation of revolution of a handwheel of the sewing apparatus by detecting revolution of the handwheel and generating an equal number of electrical pulses per revolution of the handwheel, d. accumulating selected electrical pulses by accumulating all of said electrical pulses during each generation of said first signal and inhibiting accumulating of said electrical pulses during each generation of said second signal, e. comparing said selected electrical pulses with a predetermined minimum number of electrical pulses detected from revolution of the handwheel, and f. generating a stopping signal for the sewing apparatus responsive to a particular result of the comparison of the previous step.

2. A method according to claim 1 in which each revolution of the handwheel represents one stitch and including the step of dividing each revolution of the handwheel into a series of equal segments, and in which method steps "d" and "e" are performed for each segment.

3. A method according to claim 2 including the step of counting the number of comparisons of step "e" where the selected electrical pulses are greater than the predetermined number of electrical pulses, and performing step "f" when the counted number of comparisons does not exceed a predetermined threshold number of comparisons for one revolution of the handwheel.

4. A method according to claim 3 including the step of performing step "f" when the counted number of comparisons exceeds a predetermined maximum number of comparisons for one revolution of the handwheel.

5. A system for monitoring a sewing apparatus and detecting an aberrational stitch in real time, comprising a. detecting means for sensing thread movement, b. signal means responsive to said detecting means for generating a first signal indicative of movement of thread and a second signal indicative of lack of movement of thread, c. encoder means for creating a representation of revolution of a handwheel of the sewing apparatus, said encoder means including pulse means for generating an equal number of electrical pulses per revolution of the handwheel.

d. accumulator means connected to said signal means to receive said first and second signals and responsive to said encoder means to accumulate said electrical pulses upon receipt of said first signal., said accumulator means including means to inhibit accumulation of said electrical pulses upon receipt of said second signal, e. processor means connected to said accumulator means for comparing said selected electrical pulses with a predetermined minimum number of electrical pulses received from said encoder means, and f. means to generate a stop signal for said sewing apparatus responsive to the comparison of the previous step.

6. A system according to claim 5 including a plurality of said detecting means, and including a said signal means and a said encoder means for each detecting means.

7. A system according to claim 5 in which said accumulator means comprises a counter, said counter being connected for receiving said first signal and said electrical pulses.

8. A system according to claim 5 in which said detecting means comprises a rotary encoder.

9. A system according to claim 5 including means responsive to step "f" for generating an audible alarm.

10. A system according to claim 5 including means for stopping the sewing apparatus.

* * * * *